US005110064A

United States Patent [19]

Kimura et al.

[11] Patent Number: 5,110,064

[45] Date of Patent: May 5, 1992

[54] BOBBIN CARRYING TRAY

[75] Inventors: Hidetoshi Kimura, Kyoto; Shotaro Okugawa, Ohtsu, both of Japan

[73] Assignee: Murata Kikai Kabushiki Kaisha, Kyoto, Japan

[21] Appl. No.: 694,253

[22] Filed: May 1, 1991

[30] Foreign Application Priority Data

May 8, 1990 [JP] Japan ..... 2-47894[U]

[51] Int. Cl.[5] ..... B65A 49/06

[52] U.S. Cl. ..... 242/129.5; 242/18 R; 242/35.5 A; 242/164

[58] Field of Search ..... 242/18 R, 35.5 A, 35.6 R, 242/35.6 E, 164, 129.5, 129.7, 130

[56] References Cited

U.S. PATENT DOCUMENTS

| | | | |
|---|---|---|---|
| 3,420,467 | 1/1969 | Bell | 242/164 X |
| 3,423,046 | 1/1969 | Bell | 242/164 |
| 4,463,909 | 8/1984 | Kiriake et al. | 242/35.5 A |
| 4,601,434 | 7/1986 | Mori et al. | 242/164 X |
| 4,872,620 | 10/1989 | Brown | 242/164 X |

*Primary Examiner*—Stanley N. Gilreath

*Attorney, Agent, or Firm*—Spensley Horn Jubas & Lubitz

[57] ABSTRACT

A bobbin carrying tray having an air passage extending through a peg adapted for insertion in a bobbin, and through a base underlying it. Some linear members are provided at the midway portion of the air passage to prevent the passing of yarn which is suspended in a bobbin by the air drawn through the air passage.

11 Claims, 1 Drawing Sheet

BOBBIN CARRYING TRAY

FIELD OF THE INVENTION

This invention relates to a bobbin carrying tray for carrying a bobbin in an upright position.

RELATED ART STATEMENT

A bobbin carrying tray which permits the appropriate suspension of an end portion of yarn in a bobbin is disclosed in Japanese Utility Model Application laid open to the public under No. 70186/1987.

As shown in FIGS. 3 and 4, such a bobbin carrying tray includes a peg 1 adapted for insertion in a bobbin to hold it in an upright position, a base 2 forming an integral part thereof has an air passage 3 extending from the upper end of the peg 1 to the lower end of the base 2, and a yarn shutoff member 4 which prevents yarn Y from passing through without hindering the flow of air therethrough.

This bobbin carrying tray has made it possible to prevent the end of yarn Y from projecting down through the base 2, even if a long end portion of yarn Y is sucked into a take-up tube 5 for a bobbin B by the air drawn through the air passage 3 when the end of yarn Y is led in the tube 5, thereby enabling the carrying of the bobbin in a stable way without having the yarn Y dragged on the surface 7 of a belt conveyor 6 during e.g. its traveling.

A grid-like net and a plate perforated with a multiplicity of apertures are disclosed as specific examples of the yarn shutoff member 4.

It has, however, been found that, when a net, or plate as disclosed in the above is used as the yarn shutoff member 4, it is sometimes clogged with cotton waste gathering on it.

It has, therefore, been found likely that the flow of air through the air passage 3 may become too weak to ensure the insertion of the leading end of the yarn Y into the take-up tube 5 or the blowing up of the end of yarn Y in an automatic winder.

OBJECT AND SUMMARY OF THE INVENTION

Under these circumstances, it is an object of this invention to provide a bobbin carrying tray which can keep the end of yarn from reaching down through its base and is also free from any possibility of being clogged with cotton waste.

According to this invention, an air passage extending through a peg adapted for insertion in a bobbin, and through a base underlying is provided approximately midway with linear members extending in an ascending slope from an inner wall of the passage and terminating in the vicinity of a central axis of the air passage axis.

The linear members prevent the passing of yarn which is suspended in a bobbin by the air drawn through the air passage, and the cotton waste which has gathered on the linear members is scattered away by the air used for blowing up the end of yarn.

DETAILED DESCRIPTION OF THE PREFERRED EMBODIMENT

An embodiment of this invention will now be described with reference to the accompanying drawings.

Figure 1:
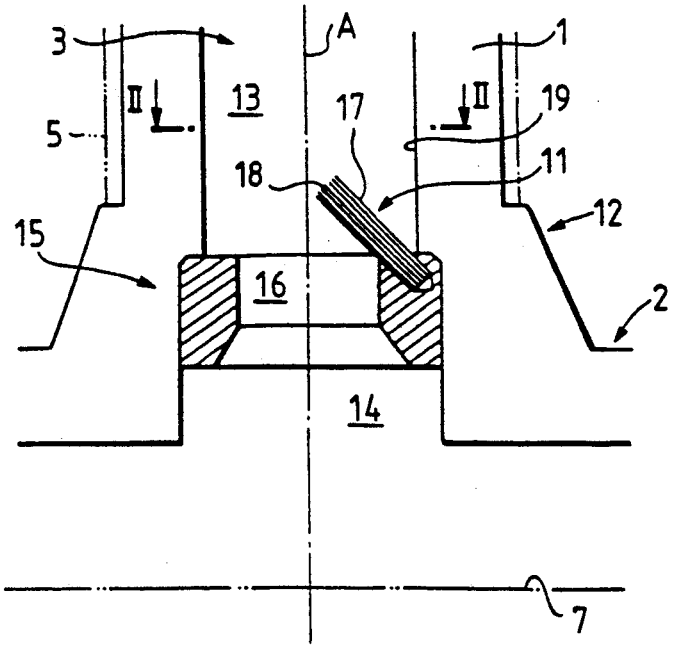
FIG. 1 is a longitudinal sectional view of a bobbin carrying tray embodying this invention.
Figure 2:
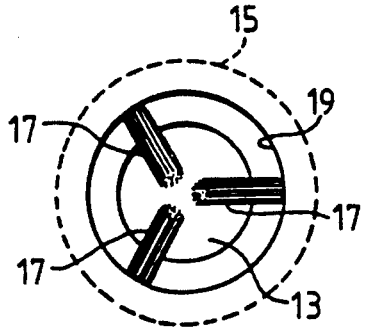
FIG. 2 is a sectional view taken along the line II—II of FIG. 1.
Figure 3:
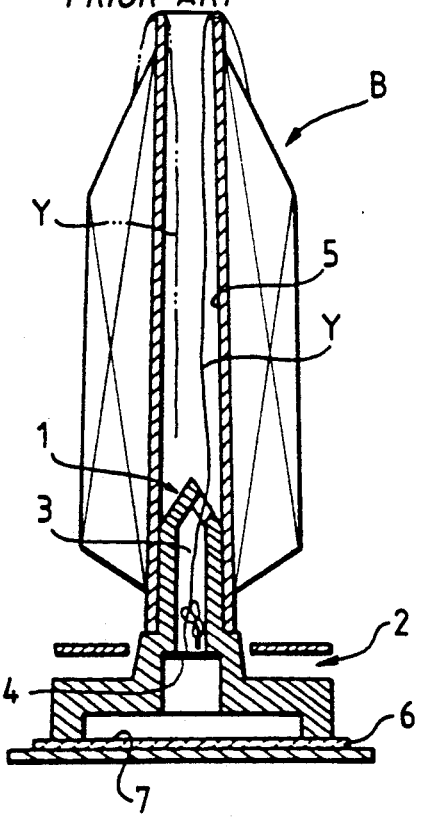
FIG. 3 PRIOR ART
FIG. 3 is a longitudinal sectional view of a conventional bobbin carrying tray.
Figure 4:
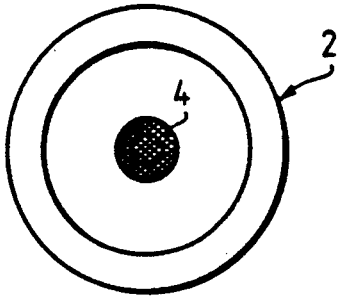
FIG. 4 PRIOR ART
FIG. 4 is a bottom plan view thereof.

FIGS. 1 and 2 show an embodiment of this invention, and include certain numerals that have been used for the description of the prior art, so that no repeated description may be necessary.

The bobbin carrying tray embodying this invention has an air passage 3 extending through a peg 1 adapted for insertion in a bobbin, and through a base 2 underlying it, as is the case with the tray known in the art. The air passage 3 is provided midway with linear members 11.

The peg 1 and the base 2 have therebetween a junction provided with a frustoconical shoulder 12 contacting the lower end of a winding tube 5 and supporting it. The air passage 3 has a diametrically enlarged portion 14 starting midway and substantially radially inwardly of the shoulder 12, and having a diameter which is somewhat larger than that of its upper portion 13. A cylindrical body 15 carrying the linear members 11 forming a salient feature of this invention is fitted and secured by an adhesive in the diametrically enlarged portion 14.

The cylindrical body 15 has an air passage 16 having a diameter which is somewhat smaller than that of the upper portion 13 of the air passage 3, extending along the axis A thereof, and including a lower portion surrounded by the base 2 and having a frustoconically enlarged diameter. The linear members 11 are mounted in the top of the cylindrical body 15. Each linear member 11 comprises a brush 17 formed by a bundle of appropriately elastic nylon filaments.

There are a total of three circumferentially spaced apart brushes 17 each extending in an ascending slope toward the axis A at an angle of about 45° and having a free end 18 located very close to the axis A. The air passage in the neighborhood of the brushes 17 is, therefore, defined by an opening around the axis A and an opening between every two adjoining brushes 17. Each brush 17 has a base end portion embedded in the top of the cylindrical body 15 and the embedded portion has a length which occupies about one-fourth of the overall length of the brush 17, while that portion of the brush 17 which extends into the air passage has a bottom engaging the wall 19 of the upper portion 13 of the air passage. Therefore, it substantially follows that the brushes 17 extend from the wall 19 of the air passage 13.

Description will now be made of the operation of the embodiment as hereinabove described.

When the tray is carrying a full bobbin B in an upright position from a fine spinning frame, an end of yarn Y is unwound before the bobbin is supplied to an automatic winder. The yarn Y which has been unwound from a layer of yarn is cut to an appropriate length and suspended in the take-up tube 5, while the air used for drawing it down is supplied into the take-up tube 5 through the air passage 3 (the diametrically enlarged portion 14, the air passage 16 and the upper portion 13). The air flows about the brushes 17 and past the free ends 18 thereof (along the axis), and does not, therefore, have its sucking force unduly weakened. The yarn Y which has been sucked in is caught by, for example, the free ends 18 of the brushes 17 and is prevented from moving down beyond them, even if it may be long enough.

The cotton waste entering the air passage 3 with the yarn Y may adhere to the brushes 17. Such cotton waste is, however, separated from the brushes 17 in the winding unit of the automatic winder, as it is forced toward the free ends 18 thereof (toward the axis A) by the air supplied for blowing up the end of yarn Y.

The brushes 17 provided midway of the air passage 3, extending in an ascending slope, and terminating in the vicinity of the axis A prevent the end of yarn Y from hanging down through the base 2, and are not blocked with any cotton waste adhering thereto, as it is easily scattered away by the air which is blown up. Thus, the tray can carry the bobbin in a stable way without calling for any maintenance work.

The cylindrical body 15 fitted in the diametrically enlarged portion 14 of the air passage 3 for positioning the brushes 17 is easily applicable to a conventional bobbin carrying tray to make it useful for a wide scope of use.

The brushes 17 can alternatively be attached directly to the wall 19 of the air passage 3.

Although the embodiment has been described as having three brushes 17, it is possible to provide more, e.g. four, equally spaced apart brushes.

Although the filamentary members 11 have been described as comprising the brushes 17, it is also possible to construct them in a variety of other ways. Each linear member may comprise anything else, such as a single yarn having a thickness which is sufficiently large to shut off the passing of any yarn, if it is a linear (or rod-shaped) member having some degree of elasticity.

This invention exhibits outstanding advantages as will be summarized below.

As the air passage extends through the peg and the base, and is provided midway with the linear members extending in an ascending slope from the wall of the passage and terminating in the vicinity of the axis thereof, it is possible to prevent the end of yarn from hanging down through the base, while ensuring the flow of air through the passage, and it is, moreover, possible to prevent any clogging with cotton waste.

What is claimed is:

1. A bobbin carrying tray comprising:

a peg for supporting a bobbin, the peg including a base portion, an air passage having a central longitudinal axis extending through the peg and the base portion, the air passage being defined by an inner wall portion of at least one of the peg and the base portion, at least one linear member extending in a sloped fashion relative to the central longitudinal axis from a location adjacent the inner wall portion of at least one of the peg and the base portion.

2. A bobbin carrying tray as claimed in claim 1, wherein the air passage includes a region into which is fitted a cylindrical body supporting the at least one linear member.

3. A bobbin carrying tray as claimed in claim 2, wherein the cylindrical body includes a passage extending therethrough having a diameter which is smaller than that of the air passage, wherein the at least one linear member is mounted in a top portion of the cylindrical body.

4. A bobbin carrying tray as claimed in claim 3, wherein the at least one linear member comprises a brush including a plurality of elastic filaments.

5. A bobbin carrying tray as claimed in claim 4, wherein a plurality of linear members are disposed on the cylindrical body, the plurality of linear members being equi-spaced about the cylindrical body.

6. A bobbin carrying tray as claimed in claim 5, wherein the plurality of linear members are comprised of elastic nylon filaments extending in an ascending slope from the cylindrical body toward the central longitudinal axis of the air passage at an angle of approximately 45°, each of the plurality of linear members having a free end located adjacent to the central longitudinal axis.

7. A bobbin carrying tray as claimed in claim 1, wherein the at least one linear member is attached directly to the inner wall of the peg.

8. A bobbin carrying tray as claimed in claim 1, wherein the at least one linear member comprises a brush including a plurality of elastic filaments.

9. A bobbin carrying tray as claimed in claim 8, wherein the plurality of elastic filaments are nylon filaments.

10. A bobbin carrying tray as claimed in claim 4, wherein the plurality of elastic filaments are nylon filaments.

11. A bobbin carrying tray as claimed in claim 7, wherein the at least one linear member is comprised of a plurality of elastic nylon filaments.

* * * * *